US009724942B2

(12) United States Patent
Horade

(10) Patent No.: US 9,724,942 B2
(45) Date of Patent: Aug. 8, 2017

(54) SHEET PROCESSING APPARATUS, AND METHOD AND COMPUTER-READABLE MEDIUM THEREFOR

(71) Applicant: BROTHER KOGYO KABUSHIKI KAISHA, Nagoya, Aichi (JP)

(72) Inventor: Kenta Horade, Tokai (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/262,558

(22) Filed: Sep. 12, 2016

(65) Prior Publication Data

US 2016/0375703 A1 Dec. 29, 2016

Related U.S. Application Data

(63) Continuation of application No. 14/669,353, filed on Mar. 26, 2015, now Pat. No. 9,440,448.

(30) Foreign Application Priority Data

Mar. 28, 2014 (JP) ..... 2014-069728

(51) Int. Cl.
*B41J 29/38* (2006.01)
*B41J 11/00* (2006.01)
*B41J 2/21* (2006.01)

(52) U.S. Cl.
CPC ..... *B41J 11/008* (2013.01); *B41J 2/2135* (2013.01); *B41J 11/0095* (2013.01); *B41J 29/38* (2013.01)

(58) Field of Classification Search
USPC ..... 347/5, 9, 14
See application file for complete search history.

(56) References Cited

U.S. PATENT DOCUMENTS 5,618,120 A 4/1997 Ishikawa
6,945,721 B2 9/2005 Sato
(Continued)

FOREIGN PATENT DOCUMENTS

JP H05-32026 A 2/1993
JP H07-179248 A 7/1995
(Continued)

OTHER PUBLICATIONS

United States Notice of Allowance dated Apr. 28, 2016 received in related U.S. Appl. No. 14/669,353.
(Continued)

*Primary Examiner* — Lam Nguyen
(74) *Attorney, Agent, or Firm* — Scully, Scott, Murphy & Presser, P.C.

(57) ABSTRACT

A sheet processing apparatus including a controller configured to move a carriage from an initial position to such a position that an optical sensor traverses one of two side edges of a sheet in a scanning direction, in a direction along the scanning direction, in response to the sheet reaching a position opposed to the optical sensor, adjust a light emitting quantity of the optical sensor while the carriage is being moved, within a period from when the carriage begins to move from the initial position to when the optical sensor traverses the one side edge, calculate a position of the one side edge traversed by the optical sensor after the adjustment, based on detection values, corresponding to the light receiving quantity, output from the optical sensor after the adjustment, and identify edge positions of the two side edges based on the calculated position of the one side edge.

2 Claims, 6 Drawing Sheets

(56) References Cited

U.S. PATENT DOCUMENTS

| | | | |
|---|---|---|---|
| 7,367,642 | B2 | 5/2008 | Ouchi et al. |
| 2005/0100385 | A1 | 5/2005 | Sato |

FOREIGN PATENT DOCUMENTS

| | | | |
|---|---|---|---|
| JP | 2003-260829 | A | 9/2003 |
| JP | 2004-182361 | A | 7/2004 |

OTHER PUBLICATIONS

United States Official Action dated Aug. 14, 2015 received in related U.S. Appl. No. 14/669,353.

SHEET PROCESSING APPARATUS, AND METHOD AND COMPUTER-READABLE MEDIUM THEREFOR

CROSS-REFERENCE TO RELATED APPLICATION

This application is a continuation application of U.S. patent application Ser. No. 14/669,353, filed on Mar. 26, 2015, which claims priority under 35 U.S.C. §119 from Japanese Patent Application No. 2014-069728, filed on Mar. 28, 2014. The entire content of U.S. patent application Ser. No. 14/669,353 and the entire content of Japanese Patent Application No. 2014-069728 are incorporated herein by reference.

BACKGROUND

Technical Field

The following description relates to one or more aspects of a sheet processing apparatus.

Related Art

An image forming apparatus has been known that is configured to perform image formation on a sheet. As an example of the image forming apparatus, an inkjet printer has been known that is configured to form an image on a sheet by discharging ink droplets onto the sheet from a head while moving a carriage with the head mounted thereon along a main scanning direction. The sheet is conveyed to an image forming position (where image formation is to be performed on the sheet) along a sub scanning direction perpendicular to the main scanning direction.

As an example of the inkjet printer, a printer has been known that includes a carriage with a head and an optical sensor mounted thereon. The optical sensor is for detecting side edges of a sheet on which image formation is to be performed. Specifically, the optical sensor detects (positions of) the side edges of the sheet, e.g., by emitting light toward a sheet conveyance path and receiving reflected light from the side of the sheet conveyance path. Information on the detected positions of the side edges of the sheet is used, e.g., for adjusting timing to discharge ink droplets.

SUMMARY

According to aspects of the present disclosure, a sheet processing apparatus is provided that includes a head configured to perform predetermined processing for a sheet, an optical sensor configured to emit light toward a sheet conveyance path along which the sheet is conveyed, and output a detection value corresponding to a light receiving quantity of reflected light received by the optical sensor, a carriage configured to carry the head and the optical sensor mounted thereon, a carriage moving mechanism configured to move the carriage along a scanning direction, and a control unit configured to control the carriage moving mechanism to move the carriage from an initial position to such a position that the optical sensor traverses one of two side edges of the sheet in the scanning direction, in a single direction along the scanning direction, in response to the sheet reaching a position opposed to the optical sensor, adjust a light emitting quantity of the light emitted by the optical sensor, in a state where the carriage is being moved, within a period between a time when the carriage begins to move from the initial position and a time when the optical sensor traverses the one side edge of the sheet in the scanning direction, calculate a position, in the scanning direction, of the one side edge of the sheet traversed by the optical sensor after the adjustment of the light emitting quantity, based on detection values output from the optical sensor after the adjustment of the light emitting quantity, and identify edge positions of the two side edges of the sheet in the scanning direction, based on the calculated position of the one side edge of the sheet in the scanning direction.

According to aspects of the present disclosure, further provided is a method adapted to be implemented on one or more processors coupled with a sheet processing apparatus including a head configured to perform predetermined processing for a sheet, an optical sensor configured to emit light toward a sheet conveyance path along which the sheet is conveyed, and detect a light receiving quantity of reflected light received by the optical sensor, a carriage configured to carry the head and the optical sensor mounted thereon, and a carriage moving mechanism configured to move the carriage along a scanning direction, the method including causing the carriage moving mechanism to move the carriage from an initial position to such a position that the optical sensor traverses one of two side edges of the sheet in the scanning direction, in a single direction along the scanning direction, in response to the sheet reaching a position opposed to the optical sensor, adjusting a light emitting quantity of the light emitted by the optical sensor, in a state where the carriage is being moved, within a period between a time when the carriage begins to move from the initial position and a time when the optical sensor traverses the one side edge of the sheet in the scanning direction, calculating a position, in the scanning direction, of the one side edge of the sheet traversed by the optical sensor after the adjustment of the light emitting quantity, based on detection values output from the optical sensor after the adjustment of the light emitting quantity, and identifying edge positions of the two side edges of the sheet in the scanning direction, based on the calculated position of the one side edge of the sheet in the scanning direction.

According to aspects of the present disclosure, further provided is a non-transitory computer-readable medium storing computer-readable instructions that are executable by one or more processors coupled with a sheet processing apparatus including a head configured to perform predetermined processing for a sheet, an optical sensor configured to emit light toward a sheet conveyance path along which the sheet is conveyed, and detect a light receiving quantity of reflected light received by the optical sensor, a carriage configured to carry the head and the optical sensor mounted thereon, and a carriage moving mechanism configured to move the carriage along a scanning direction, the instructions being configured to, when executed by the one or more processors, cause the one or more processors to control the carriage moving mechanism to move the carriage from an initial position to such a position that the optical sensor traverses one of two side edges of the sheet in the scanning direction, in a single direction along the scanning direction, in response to the sheet reaching a position opposed to the optical sensor, adjust a light emitting quantity of the light emitted by the optical sensor, in a state where the carriage is being moved, within a period between a time when the carriage begins to move from the initial position and a time when the optical sensor traverses the one side edge of the sheet in the scanning direction, calculate a position, in the scanning direction, of the one side edge of the sheet traversed by the optical sensor after the adjustment of the light emitting quantity, based on detection values output from the optical sensor after the adjustment of the light emitting quantity, and identify edge positions of the two side edges of the sheet in the scanning direction, based on the calculated position of the one side edge of the sheet in the scanning direction.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, illustrative embodiments according to aspects of the present disclosure will be described with reference to the accompanying drawings.

[First Illustrative Embodiment]

Figure 1:
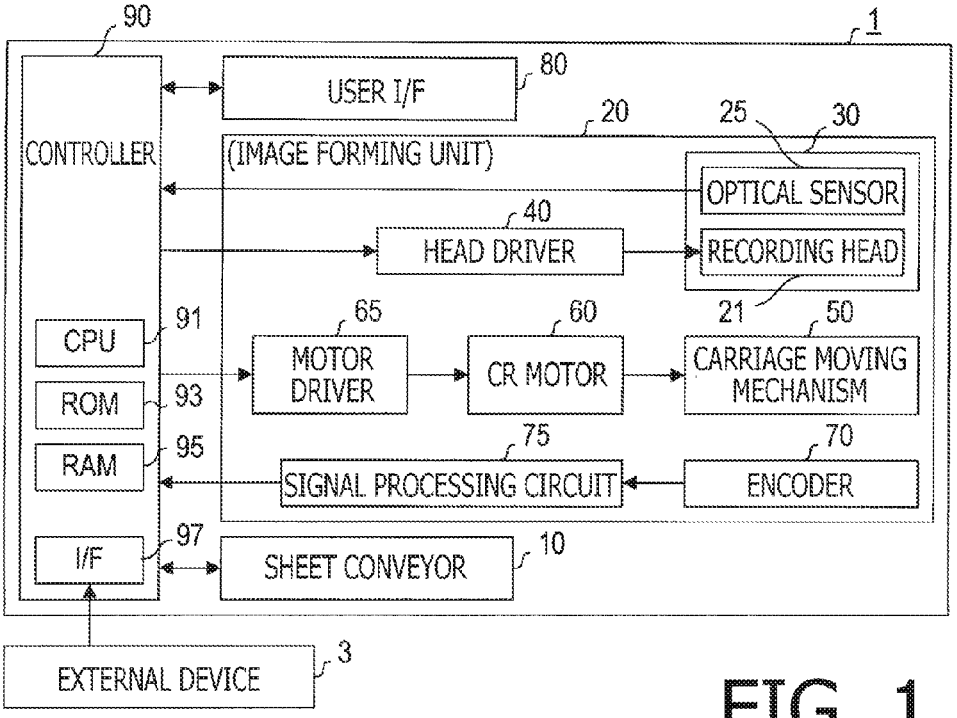
FIG. 1 is a block diagram schematically showing an electrical configuration of an image forming apparatus, according to one or more aspects of the present disclosure.

An image forming apparatus 1 of a first illustrative embodiment shown in FIG. 1 is an inkjet printer. The image forming apparatus 1 includes a sheet conveyor 10, an image forming unit 20, a user interface 80, and a controller 90.

The sheet conveyor 10 includes mechanical elements and electrical elements to achieve sheet conveyance from a feed tray (not shown) to a discharge tray (not shown). The sheet conveyor 10 is configured to convey sheets Q placed on the feed tray in a sub scanning direction in accordance with control signals from the controller 90.

Figure 2:
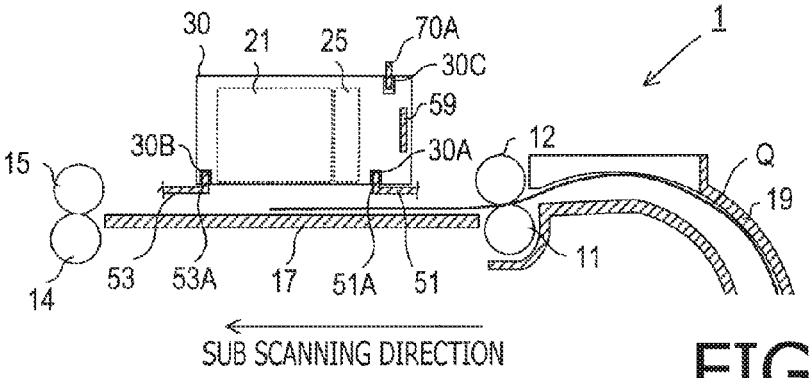
FIG. 2 is a cross-sectional view schematically showing a mechanical configuration around a carriage, according to one or more aspects of the present disclosure.

As shown in FIG. 2, the sheet conveyor 10 includes a conveying roller 11 and a driven roller 12. The conveying roller 11 and the driven roller 12 are disposed upstream relative to an image forming position in the sub scanning direction. It is noted that the image forming position is a position where a recording head 21 performs image formation on the sheets Q. The sheet conveyor 10 further includes a discharge roller 14, a driven roller 15, and a platen 17. The discharge roller 14 and the driven roller 15 are disposed downstream relative to the image forming position in the sub scanning direction. The platen 17 is disposed between the conveying roller 11 and the discharge roller 14. The platen 17 is configured to support a sheet Q. The conveying roller 11 is driven to rotate by a motor (not shown). Thereby, the conveying roller 11 and the driven roller 12, which face each other, are configured to convey in the sub scanning direction a sheet Q fed from the feed tray along a sheet feeding path 19, while pinching the sheet Q therebetween. Likewise, the discharge roller 14 is driven to rotate by the motor (not shown). Thereby, the discharge roller 14 and the driven roller 15, which face each other, are configured to convey in the sub scanning direction the sheet Q fed by the conveying roller 11 and the driven roller 12, while pinching the sheet Q therebetween.

The image forming unit 20 includes a carriage 30, a head driver 40, a carriage moving mechanism 50, a CR motor 60, a motor driver 65, an encoder 70, and a signal processing circuit 75. The carriage 30 has a recording head 21 and an optical sensor 25 mounted thereon.

Specifically, on the carriage 30, the optical sensor 25 is disposed upstream relative to the recording head 21 in the sub scanning direction. The optical sensor 25 includes a light emitting element (not shown) and a light receiving element (not shown). The optical sensor 25 is controlled by the controller 90 to emit light from the light emitting element toward a sheet conveyance path, and output a detection value corresponding to a light receiving quantity of light received by the light receiving element. The light received by the light receiving element contains reflected light as a main component. The detection values of the light receiving quantity are transmitted to the controller 90.

The recording head 21 (an example of a head) is an inkjet head configured to discharge ink droplets from nozzles in accordance with driving signals from the head driver 40. In other words, the recording head 21 is configured to discharge ink droplets onto a sheet Q and form an image on the sheet Q. The head driver 40 is configured to drive the recording head 21 in accordance with control signals from the controller 90 and cause the recording head 21 to discharge ink droplets.

The carriage moving mechanism 50 is driven by the CR motor 60 to move the carriage 30 on which the recording head 21 and the optical sensor 25 are mounted. Namely, the carriage moving mechanism 50 is connected with the carriage 30 and configured to reciprocate the carriage 30 along a main scanning direction (i.e., a normal direction of a paper surface of FIG. 2). The carriage moving mechanism 50 includes frames 51 and 53, a driving pulley 55 (see FIG. 3), a driven pulley 57, and an endless belt 59. The main scanning direction is perpendicular to the sub scanning direction.

The frames 51 and 53 are provided with guiderails 51A and 53A, respectively. The guiderails 51A and 53A extend along the main scanning direction. The carriage 30 is placed on the guiderails 51A and 53A. The driving pulley 55 and the driven pulley 57 are arranged along the main scanning direction on the frame 51. The endless belt 59 is wound around the driving pulley 55 and the driven pulley 57. The driving pulley 55 is driven to rotate by the CR motor 60. The endless belt 59 is turned together with the driven pulley 57 in accordance with rotation of the driving pulley 55. The carriage 30 is firmly attached to the endless belt 59. The carriage 30 is configured to move along the main scanning direction in response to the endless belt 59 turning.

As shown in FIG. 2, the carriage 30 includes grooves 30A and 30B formed at a bottom portion thereof. The guiderails 51A and 53A are inserted into and engaged with the grooves 30A and 30B, respectively. Thereby, the carriage 30 is configured to slide on the guiderails 51A and 53A. The carriage 30 is restricted from moving in any directions but the main scanning direction, by the guiderails 51A and 53A. In other words, the carriage 30 is allowed to move along the main scanning direction. When indirectly receiving a driving force from the CR motor 60 via the endless belt 59, the carriage 30 moves along the main scanning direction. By switching a rotational direction of the CR motor 60, the carriage 30 is allowed to reciprocate along the main scanning direction.

The CR motor 60 is a DC motor. The CR motor 60 is driven by the motor driver 65. The motor driver 65 is configured to drive and rotate the CR motor 60 in accordance with control signals from the controller 90.

Figure 3:
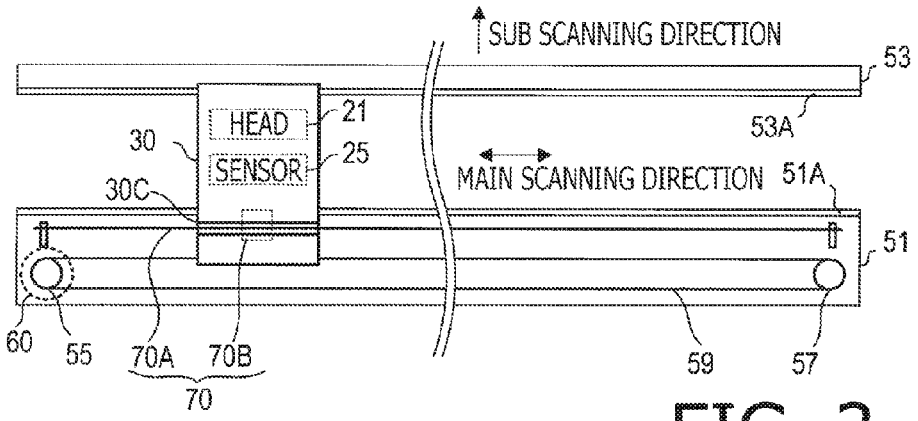
FIG. 3 is a top view schematically showing a mechanical configuration around the carriage, according to one or more aspects of the present disclosure.

The encoder 70 is configured to transmit a pulse signal generated in response to movement of the carriage 30 along the main scanning direction, as an encoder signal, to the signal processing circuit 75 (see FIG. 1). The encoder 70 is a known linear encoder. The encoder 70 includes an encoder scale 70A firmly attached to the frame 51, and a sensor 70B firmly attached to the carriage 30. As shown in FIG. 3, the encoder scale 70A is provided along the main scanning direction and inserted into a groove 30C (see FIG. 2) formed at an upper portion of the carriage 30. The sensor 70B is disposed at the groove 30C of the carriage 30. The sensor 70B is configured to move together with the carriage 30 along the main scanning direction, relative to the encoder scale 70A.

Namely, according to the encoder 70, the sensor 70B reads the encoder scale 70A while the carriage 30 is moving along the main scanning direction. The sensor 70B transmits a pulse signal responsive to the movement of the carriage 30 along the main scanning direction, as an encoder signal, to the signal processing circuit 75. The signal processing circuit 75 detects a position X and a velocity V of the carriage 30 based on the encoder signal in a known technical method. The signal processing circuit 75 transmits information on the detected position X and the detected velocity V to the controller 90.

Based on the position X of the carriage 30 received from the signal processing circuit 75 and the detection values of a light receiving quantity R received from the optical sensor 25, the controller 90 identifies respective edge positions X1 and X2 (see FIG. 4) of two side edges (i.e., a left side edge and a right side edge in FIG. 4), in the main scanning direction, of the sheet Q to be conveyed on the platen 17. Thereafter, by controlling the CR motor 60 (the carriage moving mechanism 50) and the recording head 21 based on the identified edge positions X1 and X2, the controller 90 forms a high-quality image on the sheet Q.

The controller 90 includes a central processing unit 91 (hereinafter referred to as a CPU 91 in an abbreviated form), a read-only memory 93 (hereinafter referred to as a ROM 93 in an abbreviated form), a random access memory 95 (hereinafter referred to as a RAM 95 in an abbreviated form), and an external interface 97. The external interface 97 is configured to communicate with an external device 3. The controller 90 accepts an image forming instruction from the external device 3 via the external interface 97.

The CPU 91 is configured to execute various processes in accordance with programs stored in the ROM 93. The RAM 95 is used as a work area when the CPU 91 executes the various processes. The controller 90 realizes various functions such as functions of controlling the CR motor 60 and the recording head 21, with the CPU 91 executing the various processes. The controller 90 may include circuits each specifically for realizing a corresponding one of the various processes. Namely, the controller 90 may be configured to realize the various functions by combination of processes by software and processes by hardware.

Figure 4:
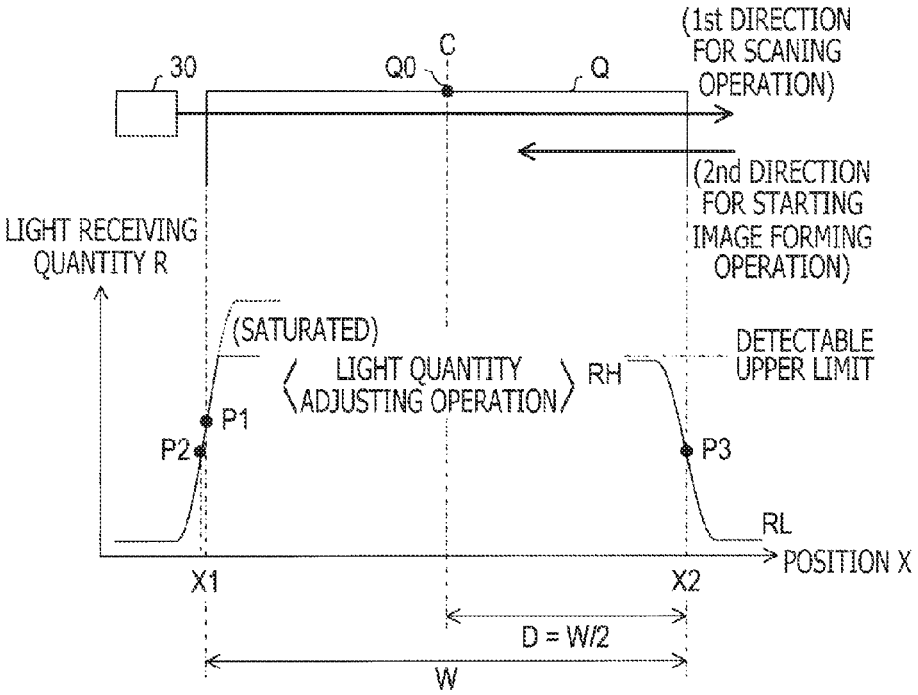
FIG. 4 shows, in an upper section thereof, two moving directions of the carriage along the main scanning direction with respect to the sheet, and shows, in a lower section of the figure, a position-dependent trajectory of a light receiving quantity output from an optical sensor on the carriage in the scanning operation, according to one or more aspects of the present disclosure.

Subsequently, an explanation will be provided about how to identify the edge positions X1 and X2 of the two side edges of a sheet Q in the main scanning direction. An upper section of FIG. 4 shows two moving directions of the carriage 30 (the optical sensor 25), i.e., a moving direction at a time of identifying the edge positions X1 and X2 of the two side edges of the sheet Q in the main scanning direction, and a moving direction at a time of starting an image forming operation on the sheet Q. A lower section of FIG. 4 shows a position-dependent variation of the light receiving quantity R, i.e., a graph with the position X of the carriage 30 in the main scanning direction as a horizontal axis and the light receiving quantity R detected by the optical sensor 25 as a vertical axis. In the following description, it is to be understood that the position X of the carriage 30 in the main scanning direction represents a central position, in the main scanning direction, of a light receiving area of the optical sensor 25 mounted on the carriage 30. In this regard, however, the position X of the carriage 30 in the main scanning direction may be regarded as any position of the carriage 30 in the main scanning direction, since a relative positional relationship between any positions of the carriage 30 is constant.

In the first illustrative embodiment, when receiving an image forming instruction from the external device 3, the image forming apparatus 1 begins to feed a sheet Q from the feed tray, and conveys the sheet Q to a cueing position (a cueing operation). The cueing position represents a position in the sub scanning direction to enable image formation from a head (beginning) of an image-formed area of the sheet Q. When the sheet Q is conveyed to the cueing position, the optical sensor 25 is allowed to traverse the sheet Q in the main scanning direction, along with movement of the carriage 30 in the main scanning direction. Thus, it is possible to detect the edge positions X1 and X2 of the two side edges of the sheet Q in the main scanning direction with the optical sensor 25.

When the cueing operation for the sheet Q is completed, as shown in the upper section of FIG. 4, the image forming apparatus 1 moves the carriage 30 from an initial position in a first direction along the main scanning direction while holding the sheet Q in the cueing position. In the process of moving the carriage 30 in the first direction, the controller 90 acquires detection values of the light receiving quantity R by the optical sensor 25. Then, based on the detection values, the controller 90 identifies the edge positions X1 and X2 of the two side edges of the sheet Q in the main scanning direction. Thereafter, the image forming apparatus 1 begins an image forming operation on the sheet Q, and drives the recording head 21 while moving the carriage 30 in a second direction opposite to the first direction along the main scanning direction. The initial position is such a position that the optical sensor 25 is placed outside a sheet passing area on the platen 17. The sheet passing area is defined as an area over which a maximum-size sheet printable by the image forming apparatus 1 passes while being conveyed over the platen 17. The initial position is set, e.g., as a home position of the carriage 30.

An explanation will be provided below about how to determine the edge positions X1 and X2 of the two side edges of the sheet Q in the main scanning direction based on the detection values corresponding to the light receiving quantity R. In the first illustrative embodiment, a surface of the platen 17 has a dark color. Meanwhile, in general, the sheet Q to be conveyed is a white paper. Therefore, the detection value of the light receiving quantity R output from the optical sensor 25 takes a low detection value RL when the sheet Q does not exist in an area on the platen 17 that faces the light receiving area of the optical sensor 25. Meanwhile, the value of the light receiving quantity R output from the optical sensor 25 takes a high detection value RH when the sheet Q exists in the area on the platen 17 that faces the light receiving area of the optical sensor 25. In a process that the optical sensor 25 is traversing the two side edges of the sheet Q in the main scanning direction, there are moments at which the sheet Q only exists in a part of the area on the platen 17 that faces the light receiving area of the optical sensor 25. Hence, in the process, the light receiving quantity R (which corresponds to the detection value output from the optical sensor 25) continuously varies between the low detection value RL and the high detection value RH.

Thus, based on a detection value profile (i.e., a position-dependent variation of the detection values) of the varying light receiving quantity R, the controller 90 specifies the low detection value RL and the high detection value RH. It is noted that the low detection value RL is specified as a detection value of the light receiving quantity R when the light receiving area of the optical sensor 25 is entirely outside (a surface area of) the sheet Q. Further, the high detection value RH is specified as a detection value of the light receiving quantity R when the light receiving area of the optical sensor 25 is entirely within (the surface area of) the sheet Q. Then, the controller 90 determines positions X where the light receiving quantity R takes a detection value corresponding to a threshold value between the low detection value RL and the high detection value RH, as the edge positions X1 and X2 of the two side edges of the sheet Q in the main scanning direction.

Although an appropriate value for the threshold value depends on a shape of the light receiving area and properties of the optical sensor 25, it is possible to determine the threshold value based on the low detection value RL and the high detection value RH. In a case of the light receiving area having a circular shape, when a central position of the light receiving area of the optical sensor 25 is coincident with one of the two side edges of the sheet Q in the main scanning direction, it means that the sheet Q exists in half of the entire light receiving area. In this case, the light receiving quantity R is theoretically determined to be a detection value equal to an average value of the low detection value RL and the high detection value RH, i.e., (RL+RH)/2. Accordingly, in this case, it is possible to set the threshold value to (RL+RH)/2. Namely, it is possible to determine positions X where the light receiving quantity R takes the detection value equal to an intermediate value (i.e., the average value "(RL+RH)/2") between the low detection value RL and the high detection value RH, as the edge positions X1 and X2 of the two side edges of the sheet Q in the main scanning direction.

Nevertheless, in order to accurately calculate the edge positions X1 and X2 of the two side edges of the sheet Q in the main scanning direction with reference to the threshold value determined based on the low detection value RL and the high detection value RH, the following condition is required. That is, the high detection value RH needs to be acquired in a situation where (any true value of) the light receiving quantity R does not exceed a detectable upper limit of the optical sensor 25 (i.e., any detection value of the light receiving quantity R is not saturated). Therefore, in the first illustrative embodiment, a light emitting quantity of light emitted by the optical sensor 25 needs to be adjusted such that (any true value of) the light receiving quantity R does not exceed the detectable upper limit of the optical sensor 25 (i.e., it needs to be adjusted such that any detection value of the light receiving quantity R is not saturated).

In a known technique, however, the optical sensor 25 is moved along the main scanning direction after adjustment of the light emitting quantity, and acquires detection values of the light receiving quantity R with the adjusted light emitting quantity while traversing the two side edges of the sheet Q in the main scanning direction. Therefore, when the known technique is applied to the image forming apparatus 1, the carriage 30 needs to be moved back to the initial position after adjustment of the light emitting quantity on the sheet Q and thereafter moved in the first direction. Thus, in this case, it is not possible to efficiently identify the edge positions X1 and X2.

In the first illustrative embodiment, firstly, the image forming apparatus 1 (the controller 90) moves the carriage 30 in the first direction from the initial position without adjusting the light emitting quantity. Then, the controller 90 adjusts the light emitting quantity of the optical sensor 25 while moving the carriage 30 in a process that the optical sensor 25 is carried from the edge position X1 to the position X2. It is noted that the edge position X1 is a position, in the main scanning direction, of a first side edge of the sheet Q that is closer to the initial position of the carriage 30. Further, the edge position X2 is a position, in the main scanning direction, of a second side edge of the sheet Q that is farther from the initial position of the carriage 30. Additionally, the detection values of the light receiving quantity R are not used to identify the edge position X1 of the first side edge of the sheet Q, but used to identify the edge position X2 of the second side edge of the sheet Q.

Thus, when the light emitting quantity of the optical sensor 25 is adjusted, the adjustment is completed before the optical sensor 25 traverses the second side edge of the sheet Q. Therefore, it is possible to accurately calculate the edge position X2 of the second side edge of the sheet Q from the high detection value RH and the low detection value RL. In the first illustrative embodiment, a position XA2 calculated as above is identified as the edge position X2 of the second side edge of the sheet Q in the main scanning direction.

In the disclosure, the position XA2 represents the calculated position of the second side edge of the sheet Q that is a position determined based on the detection values RH and RL acquired when the optical sensor 25 traverses the second side edge. For example, the position XA2 may be an intermediate value between the high detection value RH and the low detection value RL. Likewise, in the disclosure, a position XA1 represents a calculated position of the first side edge of the sheet Q that is a position determined based on the detection values RH and RL acquired when the optical sensor 25 traverses the first side edge.

In the first illustrative embodiment, based on the position XA2 and size information of the sheet Q (i.e., information on a width W of the sheet Q in the main scanning direction), a position XB1 of the first side edge of the sheet Q in the main scanning direction is calculated. The position XB1 is expressed as "XB1=(XA2−W)." The calculated position XB1 is identified as the edge position X1 of the first side edge of the sheet Q in the main scanning direction. In the disclosure, a position XB1 represents a calculated position of the first side edge of the sheet Q that is a position determined based on the position XA2 of the second side edge and the width W of the sheet Q.

The size information of the sheet Q is received from the external device 3 via the external interface 97, when an image forming instruction is issued at the external device 3. Nevertheless, when the received size information is not correct, it is not possible to accurately identify the edge position X1 of the first side edge of the sheet Q in the main scanning direction. In the first illustrative embodiment, in consideration of the undesired case as above, the image forming apparatus 1 (the controller 90) is configured to determine whether the received size information is correct or not, based on the low detection value RL and the high detection value RH that are detection values of the light receiving quantity R acquired when the optical sensor 25 traverses the first side edge of the sheet Q in the main scanning direction before adjustment of the light emitting quantity.

As understood from FIG. 4 as well, a detection value of the light receiving quantity R acquired before adjustment of the light emitting quantity might be saturated (i.e., a true value of the light receiving quantity R might exceed the detectable upper limit of the optical sensor 25). In this case, the high detection value RH detected by the optical sensor 25 contains a significant error between the true value and the actual detection value. Accordingly, in this case, it might not be possible to accurately determine the edge position X1 of the first side edge of the sheet Q in the main scanning direction, depending on the position XA1 of the first side edge calculated based on the detection values RL and RH (e.g., the position XA1 may be an intermediate value between the detection values RL and RH).

However, the position XA1 is accurate enough to determine whether the size information received from the external device 3 is correct or not. Thus, in the first illustrative embodiment, information on the position XA1 is used to determine whether the received size information is correct or not. A value of the light receiving quantity R in the position XA1, which value is, e.g., equivalent to the intermediate value between the detection values RL and RH, corresponds to a value of the light receiving quantity R at a point P2 shown in FIG. 4. A value of the light receiving quantity R in the accurate position of the first side edge of the sheet Q corresponds to a value of the light receiving quantity R at a point P1 shown in FIG. 4. Further, a value of the light receiving quantity R in the accurate position of the second side edge of the sheet Q corresponds to a value of the light receiving quantity R at a point P3 shown in FIG. 4. The edge position X2 corresponds to the position XA2.

Subsequently, a main control process will be described in detail with reference to FIG. 5. The main control process is adapted to be executed by the controller 90 when the controller 90 receives an image forming instruction from the external device 3. The main control process includes a procedure to identify the edge positions X1 and X2 of the two side edges of the sheet Q in the main scanning direction in the aforementioned method. The main control process further includes a procedure to form a high-quality image on the sheet Q by controlling the recording head 21 to discharge ink droplets based on the identified edge positions X1 and X2. The image forming instruction contains image data of the image to be formed and the size information of the sheet Q input by a user at the external device 3.

Figure 5:
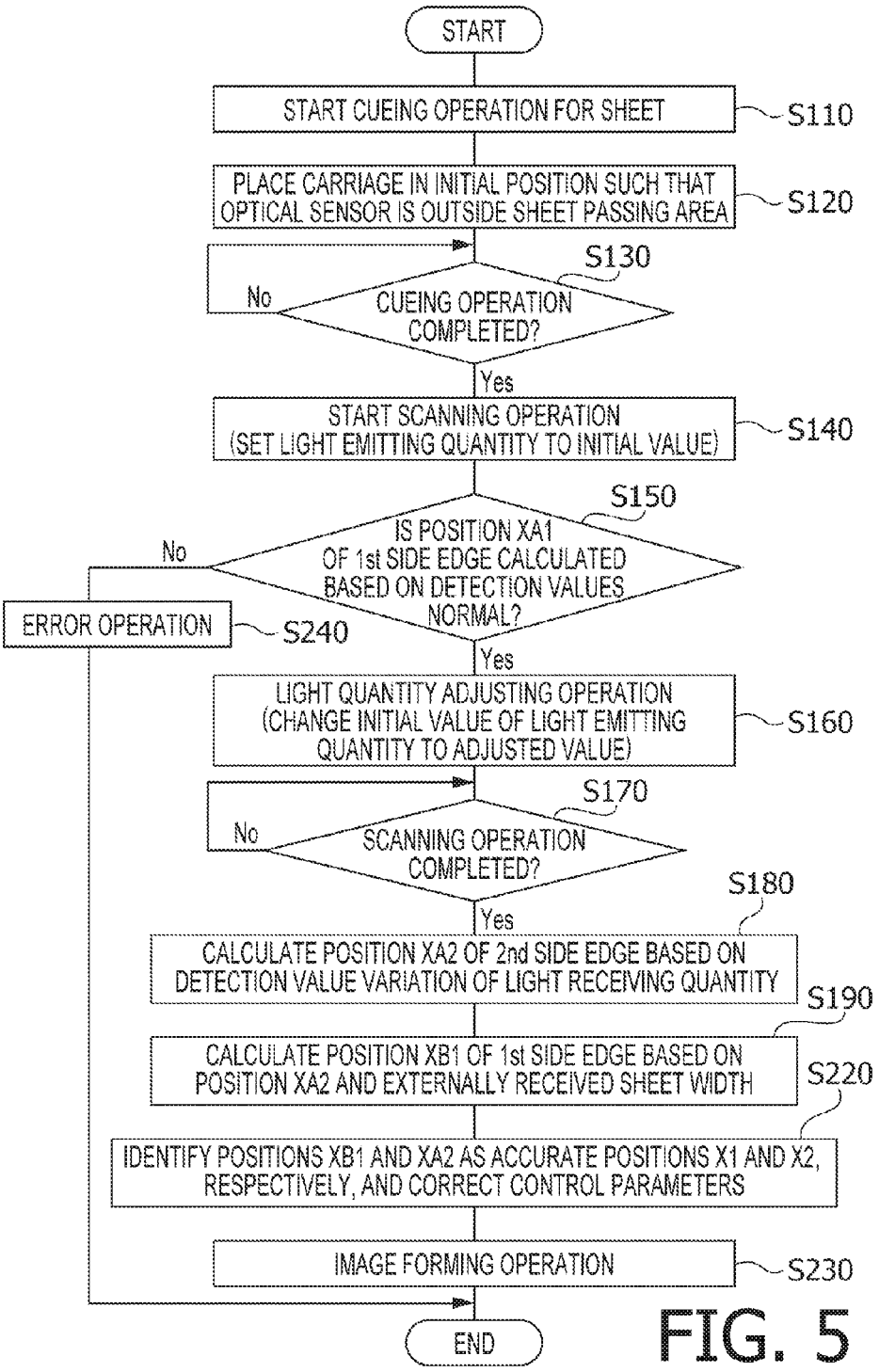
FIG. 5 is a flowchart showing a procedure of a main control process to be executed by a controller, according to one or more aspects of the present disclosure.

After launching the main control process shown in FIG. 5, the controller 90 first begins the cueing operation for a sheet Q placed on the feed tray (S110). In the cueing operation, the controller 90 controls the sheet conveyor 10 to feed the sheet Q from the feed tray until the sheet Q reaches the cueing position.

Further, until the cueing operation is completed, the controller 90 controls the CR motor 60 (and the carriage moving mechanism 50) such that the carriage 30 is placed in a predetermined initial position (S120). The initial position is previously determined as a starting position for a scanning operation to be started in S 140. When the initial position is the home position of the carriage 30, the carriage 30 is already placed in the initial position at the time when the main control process is started. Therefore, in this case, any substantial operation is not performed in S120.

After the carriage 30 is placed in the initial position, the controller 90 waits until the sheet Q is stopped in the cueing position (S130). Then, when determining that the cueing operation is completed (S130: Yes), the controller 90 starts the scanning operation (S140).

In the scanning operation, the controller 90 controls the CR motor 60 and thereby moves the carriage 30 in the first direction along the main scanning direction from the initial position to a position where the optical sensor 25 traverses the second side edge of the sheet Q. Further, at the same time, the controller 90 stores detection values of the light receiving quantity R detected by the optical sensor 25 into the RAM 95 in association with the position X acquired from the signal processing circuit 75.

The light emitting quantity at the time when the scanning operation is started to a standard value stored in the ROM 93 or a previous adjustment value stored in the RAM 95. The previous adjustment value is updated to an adjusted value of the light emitting quantity each time the light emitting quantity is adjusted. The standard value is set as an initial value of the light emitting quantity when there is not any previous adjustment value stored in the RAM 95. For instance, the standard value may be a maximum settable value of the light emitting quantity. The light emitting quantity is changed in a below-mentioned light quantity adjusting operation.

When the scanning operation is started in S140, the controller 90 performs the following operations (S150). Specifically, in S150, while continuing to perform the scanning operation, the controller 90 calculates the position XA1 of the first side edge (which is an side edge close to the initial position) of the sheet Q in the main scanning direction based on a low detection value RL and a high detection value RH (which are identified as values detected before and after a rise edge in a position-dependent variation of the light receiving quantity R, respectively). Further, in S150, the controller 90 determines whether the calculated position XA1 conforms to the size information of the sheet Q contained in the image forming instruction received from the external device 3. The determination in S150 may be made at a moment when the optical sensor 25 has completely traverses the first side edge of the sheet Q, and the detection value of the light receiving quantity R has completely risen.

In the first illustrative embodiment, the image forming apparatus 1 (the sheet conveyor 10) is configured to convey the sheet Q in the sub scanning direction from the feed tray in such a manner that a central point Q0 (see FIG. 4) of the sheet Q in a sheet width direction along the main scanning direction moves along a reference line C on the sheet conveyance path. The reference line C is a line (such as a center line) parallel to the sub scanning direction. In this case, based on the size information of the sheet Q, it is possible to estimate an allowable range within which each of the edge positions X1 and X2 of the two side edges of the sheet Q in the main scanning direction should be. In S150, it is determined whether the calculated position XA1 is within the estimated allowable range of the first side edge of the sheet Q. By the determination, it is determined whether the calculated position XA1 conforms to the size information of the sheet Q.

When determining that the calculated position XA1 does not conform to the size information of the sheet Q (S150: No), the controller 90 executes an operation of S240. In S240, the controller 90 outputs error information that the controller 90 could not identify the edge positions of the two side edges of the sheet Q in the main scanning direction, to the user via the user interface 80. The error information may be output as sound information or displayed information. Thereafter, the controller 90 terminates the main control process. At this time, the controller 90 cancels execution of the image forming operation responsive to the image forming instruction.

Meanwhile, when determining that the calculated position XA1 conforms to the size information of the sheet Q (S150: Yes), the controller 90 executes an operation of S160. In S160, the controller 90 performs a light quantity adjusting operation. In the light quantity adjusting operation, the light emitting quantity is adjusted to be an optimum value so as to achieve accurate detection of the positions of the two side edges of the sheet Q in the main scanning direction. The optimum value of the light emitting quantity may be a large value within such a range that (any true value of) the light receiving quantity R does not exceed the detectable upper limit of the optical sensor 25 (i.e., a large value within such a range that any detection value of the light receiving quantity R is not saturated).

The light quantity adjusting operation to be started after the optical sensor 25 has passed over the first side edge of the sheet Q is performed when the carriage 30 is being moved in such a manner that the adjustment of the light emitting quantity is completed until the optical sensor 25 reaches the second side edge of the sheet Q. In the light quantity adjusting operation, when the adjustment of the light emitting quantity is completed, the controller 90 updates the previous adjustment value stored in the RAM 95 to the value adjusted in this operation. Thereafter, the controller 90 executes an operation of S170.

In S170, the controller 90 waits until the carriage 30 reaches a scanning-completed position, and the scanning operation is completed. The scanning-completed position is a predetermined position located downstream in the first direction relative to a position where the optical sensor 25 traverses the second side edge of the sheet Q. When determining that the scanning operation is completed (S170: Yes), the controller 90 executes an operation of S180.

In S180, the controller 90 identifies a high detection value RH and a low detection value RL of the light receiving quantity R, which are detection values acquired before and after the time when the optical sensor 25 has traversed the second side edge of the sheet Q, respectively. More specifically, the detection values RH and RL are identified as values detected before and after a fall edge in a position-dependent variation of the light receiving quantity R acquired after the adjustment of the light emitting quantity in the scanning operation. Then, the controller 90 calculates the position XA2 of the second side edge of the sheet Q based on the detection values RH and RL.

Subsequently, the controller 90 calculates the position XB1 of the first side edge of the sheet Q using the expression "XB1=(XA2−W)," based on the calculated position XA2 of the second side edge of the sheet Q and the width W of the sheet Q (S190). The width W is specified by the size information contained in the image forming instruction received from the external device 3.

Then, in S220, the controller 90 identifies the position XB1 calculated in S190, as the edge position X1 of the first side edge of the sheet Q in the main scanning direction. Additionally, in S220, the controller 90 identifies the position XA2 calculated in S180, as the edge position X2 of the second side edge of the sheet Q in the main scanning direction. Further, in S220, the controller 90 corrects control parameters to values suitable for image formation on the sheet Q having two side edges in the identified edge positions X1 and X2 in the main scanning direction. The control parameters include a parameter to define timing for discharging ink droplets.

Thereafter, the controller 90 performs an image forming operation to form, on the sheet Q, the image based on the image data contained in the image forming instruction received from the external device 3, in accordance with the corrected control parameters. Thereby, the controller 90 forms an appropriate image complying with the sheet position, on the sheet Q (S230). Specifically, while controlling the CR motor 60 to drive the carriage moving mechanism 50 to move the carriage 30 along the main scanning direction, the controller 90 controls the recording head 21 to discharge ink droplets with appropriate timing complying with the sheet position. Thereby, the controller 90 properly forms the image based on the image data, on the sheet Q.

The moving direction of the carriage 30 when image formation is performed on the sheet Q in the cueing position is the second direction opposite to the first direction in which the carriage 30 is moved in the scanning operation. When completing image formation on the sheet Q in the cueing position, the controller 90 controls the recording head 21 to discharge ink droplets each time conveying the sheet Q by a predetermined length in the sub scanning direction and turning around the carriage 30 along the main scanning direction. Thereby, the controller 90 forms the image based on the image data, on the sheet Q. Thereafter, the controller 90 controls the sheet conveyor 10 to discharge the sheet Q with the image completely formed thereon. Then, the controller 90 terminates the main control process.

Hereinabove, the image forming apparatus 1 of the first illustrative embodiment has been described. In the first illustrative embodiment, the position XA2 of the second side edge of the sheet Q in the main scanning direction is accurately calculated based on the detection results of the light receiving quantity R acquired when the optical sensor 25 traverses the second side edge of the sheet Q after adjustment of the light emitting quantity. Further, the position XB1 of the first side edge of the sheet Q in the main scanning direction is accurately calculated based on the calculated position XA2 and the size information of the sheet Q. Thus, the calculated positions XB1 and XA2 are identified as the edge positions X1 and X2 of the two side edges of the sheet Q in the main scanning direction.

Moreover, in the first illustrative embodiment, the light emitting quantity is adjusted before the optical sensor 25 traverses the second side edge of the sheet Q in the main scanning direction, in the process of carrying the optical sensor 25 toward the second side edge of the sheet Q.

Thereby, in the process of moving the carriage 30 in a single direction (along the main scanning direction), the image forming apparatus 1 (the controller 90) sequentially performs adjustment of the light emitting quantity and calculation of the position of one side edge of the sheet Q in the main scanning direction based on the detection values of the light receiving quantity R acquired after the adjustment of the light emitting quantity, and then calculates the position of the other side edge of the sheet Q in the main scanning direction based on the calculated position of the one side edge of the sheet Q and the size information of the sheet Q. Thus, in the first illustrative embodiment, it is possible to accurately identify the edge positions X1 and X2 of the two side edges of the sheet Q in the main scanning direction without having to reciprocate the carriage 30.

Hence, according to the first illustrative embodiment, it is possible to efficiently identify the edge positions X1 and X2 of the two side edges of the sheet Q in the main scanning direction, and promptly start an image forming operation. Namely, according to the first illustrative embodiment, it is possible to shorten a time period between a time when an image forming instruction is issued by the user and a time when the image forming operation is started. Thus, it is possible to provide the high-performance image forming apparatus 1 to the user.

Especially, according to the first illustrative embodiment, the moving direction (the first direction) of the carriage 30 in the scanning operation is set opposite to the moving direction (the second direction) of the carriage 30 at the time when the image forming operation is started after the scanning operation. Therefore, it is possible to start the image forming operation promptly after the scanning operation. Suppose these moving directions of the carriage 30 are the same direction, it is required to move the carriage 30 to a starting position for the image forming operation after completion of the scanning operation, and then perform the image forming operation. It leads to a lot of wasteful time. On the contrary, according to the first illustrative embodiment, it is possible to determine a stop position of the carriage 30 at the time when the scanning operation is completed as a starting position for the image forming operation. Thus, it is possible to promptly start the image forming operation.

Further, in the first illustrative embodiment, the starting position for the scanning operation is set to such a position that the optical sensor 25 is placed outside the sheet passing area. In the scanning operation, the carriage 30 is moved in such a manner that the optical sensor 25 traverses the two side edges of the sheet Q in the main scanning direction. Therefore, it is possible to secure a time long enough for adjustment of the light emitting quantity.

Further, in the first illustrative embodiment, the image forming apparatus 1 (the controller 90) calculates the position XA1 of the first side edge of the sheet Q in the main scanning direction based on the detection values of the light receiving quantity R before adjustment of the light emitting quantity. Then, the image forming apparatus 1 (the controller 90) determines whether the calculated position XA1 conforms to the size information of the sheet Q (S150). Therefore, even when the size information of the sheet Q is incorrect, it is possible to prevent an image forming operation from being performed based on an inaccurately identified position XB1. Further, in this case, the error information is output. Thus, it is possible to provide useful information to the user, and prompt the user to carry out treatment for settling the error.

[Second Illustrative Embodiment]

Subsequently, an image forming apparatus 1 of a second illustrative embodiment will be described. The image forming apparatus 1 of the second illustrative embodiment is different from the image forming apparatus 1 of the first illustrative embodiment only in a part of a main control process to be executed by a controller 90. Hereinafter, accordingly, operations to be executed by the controller 90 in the main control process will selectively be described.

Figure 6:
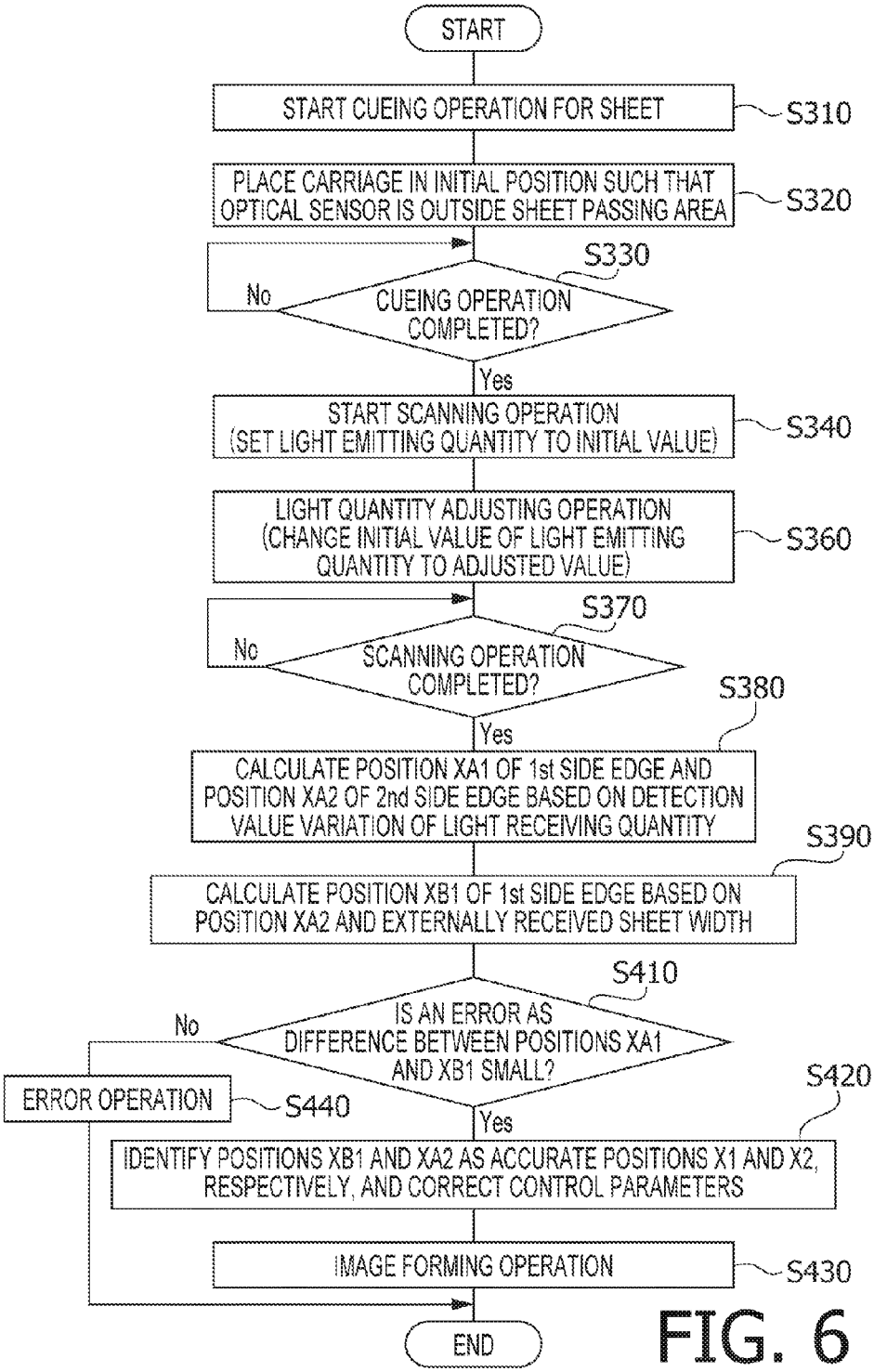
FIG. 6 is a flowchart showing a procedure of a main control process to be executed by a controller, according to one or more aspects of the present disclosure.

The controller 90 of the second illustrative embodiment starts the main control process as shown in FIG. 6, in response to receipt of an image forming instruction. In the same manner as the first illustrative embodiment, in the main control process, the controller 90 first starts a cueing operation for a sheet Q (S310). Then, in a period between a time of starting the cueing operation and a time of completing the cueing operation, the controller 90 controls the CR motor 60 such that the carriage 30 is placed in a predetermined initial position (S320). Thereafter, the controller 90 waits until the cueing operation is completed (S330). When determining that the cueing operation is completed (S330: Yes), the controller 90 starts a scanning operation in the same manner as S140 (S340).

After starting the scanning operation, the controller 90 performs a light quantity adjusting operation in the same manner as S160 (S360). Thereafter, the controller 90 waits until the scanning operation is completed. When determining that the scanning operation is completed (S370: Yes), the controller 90 calculates the position XA1 of the first side edge of the sheet Q in the main scanning direction, based on a low detection value RL and a high detection value RH detected before adjustment of the light emitting quantity (S380). More specifically, the detection values RL and RH are identified as values detected before and after a rise edge in a position-dependent variation of the light receiving quantity R acquired before adjustment of the light emitting quantity, respectively. Further, the controller 90 calculates the position XA2 of the second side edge of the sheet Q in the main scanning direction, based on a high detection value RH and a low detection value RL detected after adjustment of the light emitting quantity (S380). More specifically, the detection values RH and RL are identified as values detected before and after a fall edge in a position-dependent variation of the light receiving quantity R acquired after adjustment of the light emitting quantity, respectively. The calculated position XA1 may be an intermediate value between the detection values RL and RH detected before adjustment of the light emitting quantity. The calculated position XA2 may be an intermediate value between the detection values RH and RL detected after adjustment of the light emitting quantity.

After S380, in the same manner as S190, the controller 90 calculates the position XB1 of the first side edge of the sheet Q using the expression "XB1=(XA2−W)," based on the position XA2, calculated in S380, of the second side edge of the sheet Q and the width W of the sheet Q (S390). The width W is specified by the size information contained in the image forming instruction received from the external device 3. Then, the controller 90 determines whether an error E is less than a predetermined reference value (S410). The error E is an absolute value of a difference between the position XB1 of the first side edge calculated in S390 and the position XA1 of the first side edge calculated in S380, and is determined using an expression "E=|XB1−XA1|."

When determining that the error E is less than the reference value (S410: Yes), in the same manner as S220, the controller 90 identifies the position XB1 calculated in S390 as the edge position X1 of the first side edge of the sheet Q in the main scanning direction. In addition, the controller 90 identifies the position XA2 calculated in S380 as the edge position X2 of the second side edge of the sheet Q in the main scanning direction. Furthermore, the controller 90 corrects control parameters to values suitable for image formation on the sheet Q having two side edges in the identified edge positions X1 and X2 in the main scanning direction (S420). Thereafter, in the same manner as S230, the controller 90 performs an image forming operation based on the corrected control parameters (S430). Then, the controller 90 terminates the main control process.

Meanwhile, when determining that the error E is equal to or more than the reference value (S410: No), the controller 90 executes an operation of S440. In S440, in the same manner as S240, the controller 90 outputs error information that the controller 90 could not identify the positions of the two side edges of the sheet Q in the main scanning direction, to the user via the user interface 80. Then, the controller 90 terminates the main control process.

Hereinabove, the image forming apparatus 1 of the second illustrative embodiment has been described. The second illustrative embodiment, in which the error information is output as described above, provides the same advantageous effects as the first illustrative embodiment. Namely, in the same manner as the first illustrative embodiment, according to the image forming apparatus 1 of the second illustrative embodiment, even when the size information of the sheet Q received from the external device 3 is incorrect, it is possible to prevent an image forming operation from being performed based on an inaccurately identified position XB1. Thus, it is possible to prevent the user from feeling a sense of dissatisfaction when a low-quality image is formed on the sheet Q.

[Third Illustrative Embodiment]

Subsequently, an image forming apparatus 1 of a third illustrative embodiment will be described. The image forming apparatus 1 of the third illustrative embodiment is different from the image forming apparatus 1 of the first illustrative embodiment only in a part of a main control process to be executed by a controller 90. Hereinafter, accordingly, operations to be executed by the controller 90 in the main control process will selectively be described in reference with FIGS. 7 and 8.

Figure 7:
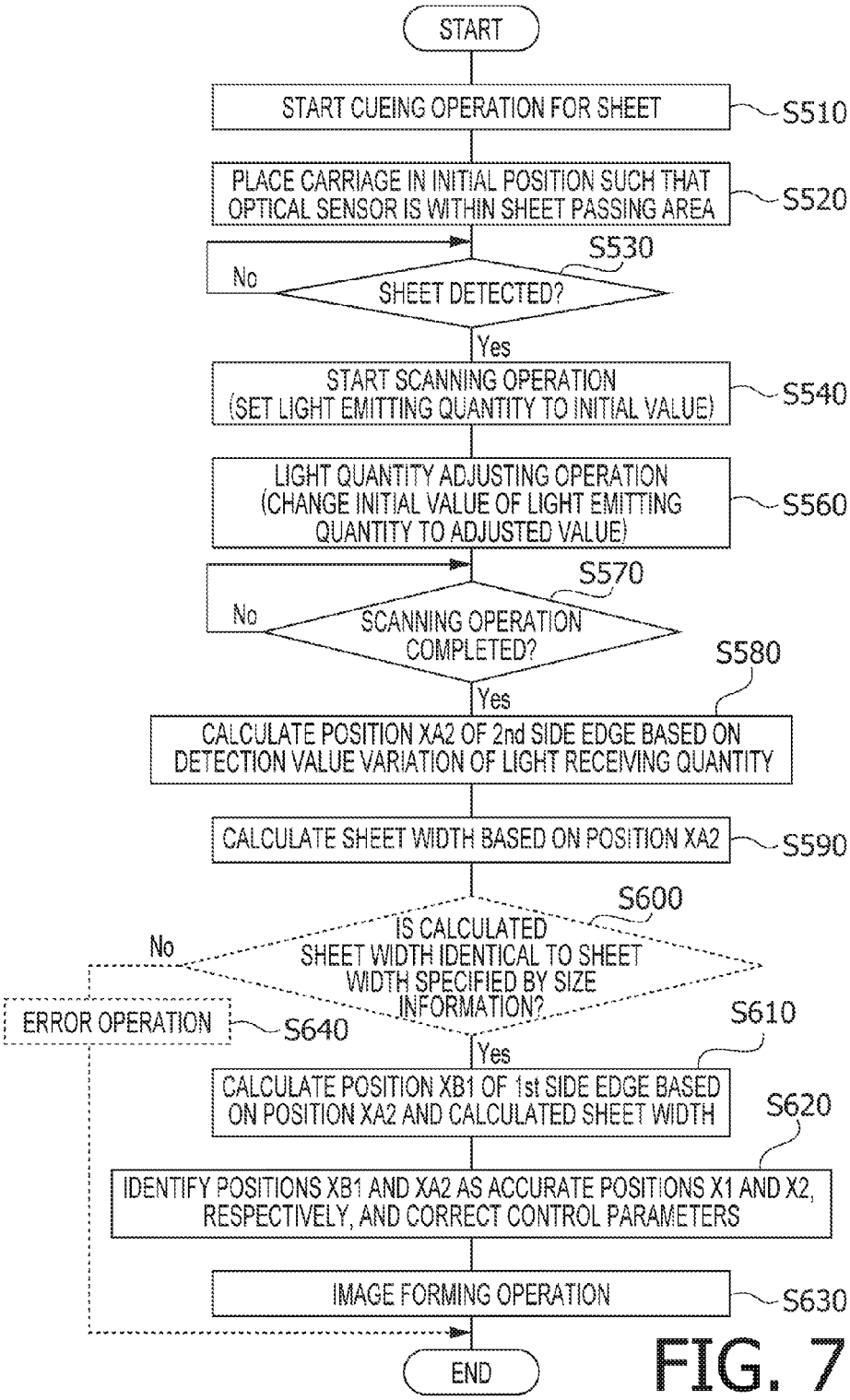
FIG. 7 is a flowchart showing a procedure of a main control process to be executed by a controller, according to one or more aspects of the present disclosure.

The controller 90 of the third illustrative embodiment starts the main control process as shown in FIG. 7, in response to receipt of an image forming instruction. In the same manner as the first illustrative embodiment, in the main control process, the controller 90 first starts a cueing operation for a sheet Q (S510). Then, the controller 90 controls the CR motor 60 such that the carriage 30 is placed in a predetermined initial position (S520).

Figure 8:
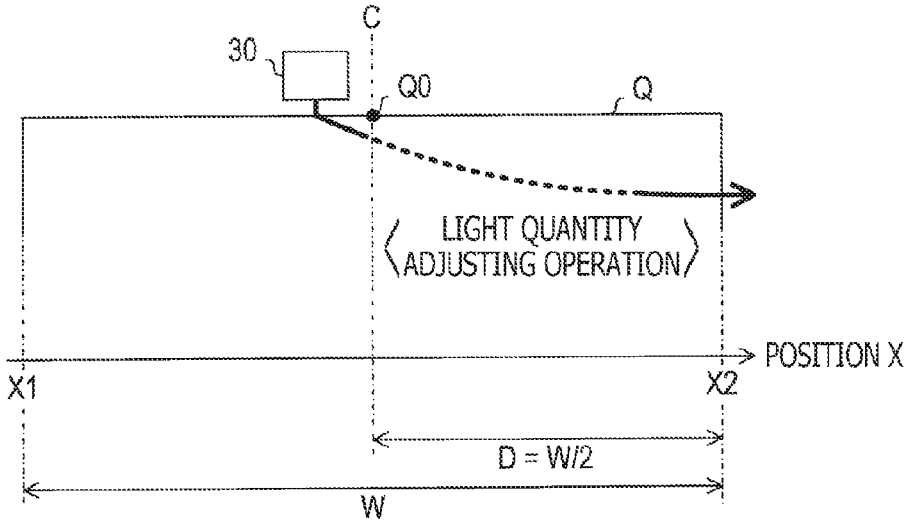
FIG. 8 shows a trajectory of a carriage that is moved in a scanning operation, in a relative coordinate system for representing relative positions with respective to a sheet, according to one or more aspects of the present disclosure.

In the third illustrative embodiment, however, the carriage 30 is not placed in such an initial position that the optical sensor 25 is placed outside the sheet passing area as exemplified in the first and second illustrative embodiments. The carriage 30 is placed in such an initial position that the optical sensor 25 is within the sheet passing area as shown in FIG. 8. Further, in the third illustrative embodiment, the carriage 30 is not placed in the initial position in a period between a time of starting the cueing operation and a time of completing the cueing operation. The carriage 30 is placed in the initial position before the cueing operation is completed, and before the sheet Q reaches a position where the optical sensor 25 is allowed to detect the sheet Q (the optical sensor 25 is allowed to receive light reflected from the sheet Q).

In FIG. 8, a bold line shows a trajectory of the carriage 30 that is moved from the initial position in a scanning operation, in a relative coordinate system for representing relative positions with respective to the sheet Q. As shown in FIG. 8, the trajectory of the carriage 30 is drawn as a curved line. Thus, the curved trajectory indicates that the scanning operation is started before the cueing operation is completed, and that the carriage 30 is moved along the main scanning direction in a state where the sheet Q is conveyed in the sub scanning direction.

The initial position to which the carriage 30 is to be moved before the scanning operation is started, i.e., a starting position for the scanning operation is determined as a below-described position within the sheet passing area in the main scanning direction. Specifically, the starting position for the scanning operation is determined as a position a predetermined distance away from the second side edge of the sheet Q in the main scanning direction. The predetermined distance is a distance necessary and sufficient for completing a light quantity adjusting operation before the optical sensor 25 traverses the second side edge of the sheet Q in the scanning operation, in which the optical sensor 25 is moved toward the second side edge so as to traverse the second side edge.

The image forming apparatus 1 is configured such that sheets Q of various sizes are fed from the feed tray. In this regard, even when a sheet Q of the minimum size printable by the image forming apparatus 1 is fed from the feed tray, it is possible to determine the starting position for the scanning operation as a position that is a distance, which is sufficient for completing the light quantity adjusting operation before the optical sensor 25 traverses the second side edge of the sheet Q, away from the second side edge of the sheet Q in the main scanning direction. Additionally, no matter how large (small) the size of a sheet Q to be fed is, it is possible to determine the starting position for the scanning operation to be within an area over which the sheet Q is to pass, in the main scanning direction.

As another example, the starting position for the scanning operation may be determined using a size of a sheet Q specified by size information contained in an image forming instruction received from the external device 3. Specifically, the starting position may be determined as a position that is within a specific range in the main scanning direction and is a specific distance away from the second side edge of the sheet Q in the main scanning direction. It is noted that the specific range is a range over which the sheet Q of the size specified by the size information is to pass. Further, the specific distance is a distance that is necessary and sufficient for completing the light quantity adjusting operation before the optical sensor 25 traverses the second side edge of the sheet Q of the specified size.

Further, depending on the size of the sheet Q, a moving velocity of the carriage 30 in the scanning operation may be changed. In this case, no matter where, within the sheet passing area, the starting position for the scanning operation is determined to be, it is possible to move the carriage 30 in the scanning operation so as to complete the light quantity adjusting operation before the optical sensor 25 traverses the second side edge of the sheet Q.

When the carriage 30 is placed in the initial position within the sheet passing area in S520, the controller 90 waits until the sheet Q is detected by the optical sensor 25 (S530). Specifically, for instance, in S530 the controller 90 may control the optical sensor 25 to emit light, monitor detection values of the light receiving quantity R, and wait until a detection value exceeds a predetermined reference value.

Namely, the controller 90 may determine that the sheet Q is detected, in response to acquiring a detection value more than the predetermined reference value from the optical sensor 25.

When determining that the sheet Q is detected (S530: Yes), the controller 90 executes an operation of S540. In S540, the controller 90 starts the scanning operation in the same manner as the first illustrative embodiment. In the third illustrative embodiment, the scanning operation is started at a time when the optical sensor 25 detects the sheet Q before the sheet Q reaches the cueing position and stops. Therefore, when the scanning operation is performed, the sheet Q is being conveyed in the sub scanning direction. Thus, the carriage 30 is moved toward the second side edge of the sheet Q in accordance with a relative trajectory as shown in FIG. 8 with respect to the sheet Q.

After starting the scanning operation, the controller 90 performs the light quantity adjusting operation in the same manner as the first illustrative embodiment (S560). In the light quantity adjusting operation, the controller 90 adjusts the light emitting quantity of the optical sensor 25 while moving the carriage 30 in a single direction. The light quantity adjusting operation is completed before the optical sensor 25 traverses the second side edge of the sheet Q.

Thereafter, the controller 90 waits for the scanning operation to be completed (S570). When determining that the scanning operation is completed (S570: Yes), the controller 90 calculates the position XA2 of the second side edge of the sheet Q in the same manner as S180 (S580). Specifically, in S580, the controller 90 calculates the position XA2 based on detection values RH and RL detected before and after a fall edge in a position-dependent variation of the light receiving quantity R acquired after the adjustment of the light emitting quantity.

Further, the controller 90 calculates a width W of the sheet Q in the main scanning direction based on a distance D between the position XA2 and a reference line C along which a central point Q0 of the sheet Q in the sheet width direction (the main scanning direction) is positioned. The distance D is half as large as the width W. Therefore, the controller 90 calculates the width W as a value twice as large as the distance D (S590).

Thereafter, the controller 90 determines whether the calculated width W is substantially identical to a width specified by the size information received from the external device 3 (S600). Specifically, the controller 90 makes an affirmative determination (S600: Yes) when a difference between the calculated width W and the width specified by the size information is within a predetermined allowable range. Meanwhile, the controller 90 makes a negative determination (S600: No) when the difference between the calculated width W and the width specified by the size information is not within the predetermined allowable range.

When determining that the calculated width W is not substantially identical to the width specified by the size information (S600: No), the controller 90 outputs error information that is substantially the same information as output in S240 and S440, via the user interface 80 (S640). Then, the controller 90 terminates the main control process. Meanwhile, when determining that the calculated width W is substantially identical to the width specified by the size information (S600: Yes), the controller 90 calculates the position XB1 of the first side edge of the sheet Q based on the position XA2 of the second side edge determined in S580 and the width W of the sheet Q determined in S590, using the expression "XB1=XA2−W" (S610).

Thereafter, in the same manner as S220, the controller 90 performs the following operations in S620. Specifically, the controller 90 identifies the position XB1 calculated in S610, as the edge position X1 of the first side edge of the sheet Q in the main scanning direction (S620). Additionally, the controller 90 identifies the position XA2 calculated in S580, as the edge position X2 of the second side edge of the sheet Q in the main scanning direction (S620). Further, the controller 90 corrects control parameters to values suitable for image formation on the sheet Q having two side edges in the identified edge positions X1 and X2 in the main scanning direction (S620). Then, in the same manner as S230, the controller 90 performs an image forming operation based on the corrected control parameters (S630). After that, the controller 90 terminates the main control process.

Hereinabove, the image forming apparatus 1 of the third illustrative embodiment has been described. According to the third illustrative embodiment, by utilizing the operational feature that the sheet Q is conveyed in the sub scanning direction in such a manner that the central point Q0 moves along the reference line C on the sheet conveyance path, it is possible to determine and identify the position XB1 of the first side edge of the sheet Q without having to use the size information received from the external device 3.

Accordingly, even though the received size information is incorrect, the incorrect size information does not have any negative influence on accuracy for identifying the edge positions X1 and X2 of the two side edges of the sheet Q in the main scanning direction. In other words, according to the third illustrative embodiment, it is possible to accurately identify the edge positions X1 and X2 of the two side edges of the sheet Q in the main scanning direction regardless of whether the received size information is correct or not. Hence, the image forming apparatus 1 of the third illustrative embodiment may be configured not to execute S600 and S640.

It is preferable to execute S600 and S640 when the central point Q0 of the sheet Q is likely to significantly depart from the reference line C, and when the size information received from the external device 3 is highly reliable. In contrast, it may be preferable not to execute S600 and S640 when the central point Q0 of the sheet Q is less likely to depart from the reference line C, and when the size information received from the external device 3 is not reliable. Namely, whether the image forming apparatus 1 is desired to be configured to execute S600 and S640 depends on conveyance accuracy for conveying the sheet Q in the sub scanning direction and correctness of the size information received from the external device 3.

In the third illustrative embodiment, the scanning operation is started at the time when the sheet Q reaches a position under the optical sensor 25. In this regard, nevertheless, if it is possible to complete the light quantity adjusting operation before the optical sensor 25 traverses the second side edge of the sheet Q, the image forming apparatus 1 may be configured to start the scanning operation before the sheet Q reaches the position under the optical sensor 25 and begin to move the carriage 30 toward the second side edge of the sheet Q in the main scanning direction.

Namely, such a moment that the optical sensor 25 comes to face the sheet Q in the light quantity adjusting operation is more than sufficiently suitable as a moment to start moving the carriage 30 from the initial position (the starting position for the scanning operation). The optical sensor 25 is not necessarily required to face the sheet Q at the moment to start moving the carriage 30 from the initial position. This applies to the first and second illustrative embodiments.

Hereinabove, the illustrative embodiments according to aspects of the present disclosure have been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

(Modification)

In S190 of the first illustrative embodiment and S390 of the second illustrative embodiment, the position XB1 of the first side edge of the sheet Q in the main scanning direction may be calculated in the same method as exemplified in S590 and S610 of the third illustrative embodiment. When the method is applied to the second illustrative embodiment, it is possible to adequately perform the error informing operation (S440) in a situation where the central point Q0 of the sheet Q departs from the reference line C.

In S610 of the third illustrative embodiment, the position XB1 of the first side edge of the sheet Q in the main scanning direction may be calculated in the same method as exemplified in S190 and S390 of the third illustrative embodiment. When the method is applied to the third illustrative embodiment, S590, S600, and S640 may be omitted. Further, the image forming apparatus 1 of the third illustrative embodiment may be configured to calculate the position XB1 of the first side edge in both the same method as exemplified in the first illustrative embodiment and the same method as exemplified in the third illustrative embodiment. In this case, the image forming apparatus 1 of the third illustrative embodiment may be configured to perform the error informing operation when a difference between values of the position XB1 calculated in the two methods is more than a predetermined reference value.

Aspects of the present disclosure may be applied to not only image forming apparatuses but also various devices configured to perform predetermined processing for sheets such as papers. For instance, aspects of the present disclosure may be applied to devices configured to perform, for sheets, physical processing and/or chemical processing other than image formation (e.g., devices having a function of cutting sheets). Further, the "sheets" referred to above may include various sheet substances each of which is formed in a rectangular shape or a belt shape having two side edges in a predetermined direction. For instance, the "sheets" referred to above may include papers, wood sheets, plastic sheets, metal sheets, and boards on which a pattern of conductive material is printed.

What is claimed is:

1. A sheet processing apparatus comprising:

a sheet conveyor configured to convey a sheet in a conveyance direction along a sheet conveyance path;

a head configured to perform predetermined processing for the sheet;

an optical sensor configured to emit light toward the sheet conveyance path, and output a detection value corresponding to a light receiving quantity of reflected light received by the optical sensor;

a carriage configured to carry the head and the optical sensor mounted thereon;

a carriage moving mechanism configured to move the carriage along a scanning direction perpendicular to the conveyance direction; and a controller configured to:

control the sheet conveyor to begin to convey the sheet to a cueing position, the cueing position being located downstream of a position where the optical sensor detects a leading end of the sheet in the conveyance direction;

before the sheet reaches the cueing position, control the carriage moving mechanism to move and place the carriage in an initial position where the optical sensor is placed within a sheet passing area in the scanning direction;

in response to the sheet being detected by the optical sensor before reaching the cueing position, control the carriage moving mechanism to begin to move the carriage from the initial position to such a position that the optical sensor traverses one of two side edges of the sheet in the scanning direction, in a single direction along the scanning direction;

adjust a light emitting quantity of the light emitted by the optical sensor, in a state where the carriage is being moved, within a period between a time when the carriage begins to move from the initial position and a time when the optical sensor traverses the one side edge of the sheet in the scanning direction;

calculate a position, in the scanning direction, of the one side edge of the sheet traversed by the optical sensor after the adjustment of the light emitting quantity, based on detection values output from the optical sensor after the adjustment of the light emitting quantity; and identify edge positions of the two side edges of the sheet in the scanning direction, based on the calculated position of the one side edge of the sheet in the scanning direction.

2. The sheet processing apparatus according to claim 1, wherein the sheet passing area is an area over which a maximum-size sheet processable by the sheet processing apparatus passes while being conveyed in the conveyance direction perpendicular to the scanning direction.

* * * * *